United States Patent [19]

Shiba et al.

[11] 3,963,499

[45] June 15, 1976

[54] PHOTOGRAPHIC LIGHT-SENSITIVE MATERIAL

[75] Inventors: Keisuke Shiba; Hideki Naito; Nobuo Yamamoto; Masakazu Yoneyama, all of Minami-ashigara, Japan

[73] Assignee: Fuji Photo Film Co., Ltd., Minami-ashigara, Japan

[22] Filed: Oct. 15, 1974

[21] Appl. No.: 514,712

[30] Foreign Application Priority Data

Oct. 12, 1973 Japan ..... 48-114436

[52] U.S. Cl. ..... 96/100; 106/125; 96/114.5

[51] Int. Cl.[2] ..... G03C 1/40; G03C 1/38

[58] Field of Search ..... 96/100, 114.5; 106/125

[56] References Cited

UNITED STATES PATENTS

| | | | |
|---|---|---|---|
| 3,676,141 | 7/1972 | Hara et al. | 96/100 |
| 3,726,683 | 4/1973 | Yamamoto et al. | 96/114.5 |
| 3,762,925 | 10/1973 | Nittel | 96/100 |
| 3,822,135 | 7/1974 | Sakai et al. | 96/120 |

*Primary Examiner*—Edward G. Whitby

*Attorney, Agent, or Firm*—Sughrue, Rothwell, Mion, Zinn & Macpeak

[57] ABSTRACT

A photographic light-sensitive material comprising a support having thereon a hydrophilic colloid layer containing at least two surface active agents selected from the group consisting of compounds represented by the general formula (I)

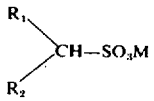

(I)

and the general formula (II)

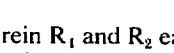

(II)

wherein $R_1$ and $R_2$ each represents an aliphatic residue with the sum of the number of carbon atoms contained in $R_1$ and $R_2$ ranging from about 8 to 32; $R_3$ represents an aliphatic residue having about 8 to 20 carbon atoms; and M represents a cation or a cationic group capable of forming a salt with a sulfonic acid. The surface active agents have no toxic physiological action and high biodegradability.

9 Claims, No Drawings

PHOTOGRAPHIC LIGHT-SENSITIVE MATERIAL

BACKGROUND OF THE INVENTION

1. Field of the Invention

This invention relates to a photographic light-sensitive material in which the use of organic substances which may cause environmental pollution in the steps of the production and of the development processing is eliminated and, more particularly, it relates to a photographic light-sensitive material containing surface active agents having no toxic physiological action and high biodegradability applied in such a manner that they exhibit excellent properties as a coating aid and as an aid for dispersing photographic additives in a light-sensitive silver halide emulsion.

2. Description of the Prior Art

In the production of a photographic light-sensitive materials, anionic, nonionic, cationic or amphoteric surface active agents are used as a coating aid, a dispersing agent, an antistatic agent, a setting agent, an agent for modifying the physical properties of interfaces, an agent for modifying the properties of a light-sensitive silver halide such as a sensitizer or an infectious development accelerator, and further photographic additives such as sensitizing dyes, antifogging agents, couplers, ultra-violet absorbants, antioxidants or dyes. Of all of these, anionic surface active agents are used in great quantities. Since a large quantity of anionic surface active agents is used also in fields other than the photographic fields, it is all the more important to develop improved techniques for overcoming environmental pollution caused by such surface active agents.

Of the anionic surface active agents used in the production of photographic light-sensitive materials, those used in the dispersion of photographic additives in a light-sensitive silver halide emulsion should, particularly, be selected carefully, regarding their performance such as their dispersibility relative to the material to be dispersed and their influence on the essential properties of the additives.

In order to disperse photographic additives, particularly, hydrophobic couplers and ultraviolet absorbants, the salts of alkylbenzenesulfonic acids or the salts of alkylnaphthalenesulfonic acids have been used. These agents are described in, e.g., Japanese Patent Publication Nos. 4293/64 and 4547/71, U.S. Pat. Nos. 2,322,027; 2,360,289; 2,801,170; 2,801,171; 2,852,382; 2,949,360; 3,396,027 and 3,619,195, German Patent Nos. 1,143,707; 2,045,414; 2,043,271 and 2,045,464. However, surface active agents which have aromatic rings are more or less disadvantageous with respect to the biodegradability and their effects on physiological action. Also, saponin has been used, as described in, for instance, British Patent Nos. 1,098,594; 1,099,415; 1,099,416 and 1,099,417. However, saponin is unsuitable because of its poor properties for dispersing photographic additives, its poor adaptability to high-speed coating of a silver halide emulsion in high concentration in conformity with present techniques, and insufficient shelf life for the preparation of a dispersion of photographic additives in high concentration. Furthermore, aliphatic sulfuric acid esters have been used, as described in, e.g., U.S. Pat. Nos. 2,304,940; 2,311,021; 2,322,027 and 2,533,514. These sulfuric acid esters tend to be hydrolyzed and, particularly, straight chain alkyl sulfuric acid esters tend to be inferior to salts of alkylbenzenesulfonic acids in dispersability when used alone as an anionic surface active agent. Mostly, they are used together with nonionic surface active agents to correct this defect, as described in, e.g., German Patent Nos. 1,942,873.

The method of solubilizing photographic additives in an aqueous solution of anionic surface active agents and then adding the same to a light-sensitive emulsion is known, as described in, e.g., U.S. Pat. No. 3,822,135. However, no clear descriptions are found in this specification as to surface active agents of the present invention. In this previously disclosed method, the salts of alkylbenzenesulfonic acids are also preferred, but they are not always desirable with respect to physiological effects and biodegradability.

SUMMARY OF THE INVENTION

This invention provides a method of overcoming these defects.

A first object of this invention is to provide a photographic light-sensitive material prepared by a process in which substances without a toxic physiological action are used.

A second object of this invention is to provide a photographic light-sensitive material prepared by a process using surface active agents which are highly biodegradable and, thus, do not cause environmental pollution if discharged during development processing.

A third object of this invention is to provide a method of employing surface active agents without a toxic physiological action and having high biodegradability for the coating of a photograhic light-sensitive emulsion, or the preparation of a dispersion of photographic additives and the improved addition thereof to an emulsion.

A fourth object of this invention is to provide a dispersion of a coupler, a hydroquinone derivative or an ultraviolet absorbant, which is particularly finely dispersed and has excellent stability with time.

These and other objects of the invention will become apparent from the following description of this invention.

The objects of this invention are accomplished by a photographic light-sensitive material comprising a support having thereon a hydrophilic colloid layer containing, in combination, at least two surfaces active agents selected from the compounds represented by the general formula (I)

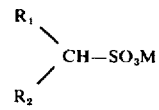

(I)

and the general formula (II)

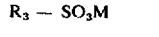

(II)

wherein in the above formulas, $R_1$ and $R_2$ each represents an aliphatic residue in which the sum of the number of carbon atoms contained in $R_1$ and $R_2$ is 8 to 32; $R_3$ represents an aliphatic residue having 8 to 20 carbon atoms; and M represents a cation or a cationic group capable of forming a salt with a sulfonic acid.

DETAILED DESCRIPTION OF THE INVENTION

In the above formulas (I) and (II), $R_1$, $R_2$ and $R_3$ are preferably an alkyl residue and M is preferably a sodium ion, a potassium ion, an ammonium ion, etc. Suitable aliphatic hydrocarbon residues include alkyl groups and alkenyl groups, such as octyl, decyl, dodecyl, pentadecyl, octadecyl, etc.

The surface active agents represented by the above general formulas (I) and (II) used in this invention can be synthesized using known process comprising sulfonation of normal-paraffins. In this process, it is well known to employ a mixture of compounds with different carbon chain lengths depending upon the carbon chain length distribution of the composition of the normal-paraffins used as a starting material, and the conditions for sulfonation are well known. That is, a mixture of the above secondary alkane sulfonates of the general formula (I) with different numbers of carbon atoms in $R_1$ and $R_2$ ranging from $CH_3$ (1 carbon atom) to $C_{18}H_{37}$ (18 carbon atoms), or a mixture of the above primary alkane sulfonates of the general formula (II) with different numbers of carbon atoms in $R_3$ ranging from $C_8H_{17}$ (8 carbon atoms) to $C_{20}H_{41}$ (20 carbon atoms) can be obtained. Moreover, a mixture of the secondary alkane sulfonate compounds represented by the general formula (I) with the primary alkane sulfonate compounds represented by the general formula (II) can also be obtained.

The production method and the composition of the surface active agents used in this invention are described in, for instance, *European Chemical News*, pp. 3 and 39, December (1966), F. Asinge *Paraffine-chemistry and Technology*, Pergamon Press (1967) or *Oil Chemistry* Vol. 19, p. 458 (1970). Typical examples of the surface active agents used in this invention include primary alkane sulfonate such as $C_8$-n-alkane solfonate, $C_9$-n-alkane sulfonate, $C_{10}$-n-alkane sulfonate, $C_{11}$-n-alkane sulfonate, $C_{12}$-n-alkane sulfonate, $C_{13}$-n-alkane sulfonate, $C_{14}$-n-alkane sulfonate, $C_{15}$-n-alkane sulfonate, $C_{16}$-n-alkane sulfonate, $C_{17}$-n-alkane sulfonate and $C_{18}$-n-alkane sulfonate, the corresponding secondary alkane sulfonates or mixtures of the above various secondary alkane sulfonates and primary alkane sulfonates.

Some of the surface active agents corresponding to these compounds are commercially available such as under the trade name "Hostapur SAS" (made by Hoechst Co., Ltd.).

The weight distribution of the compounds having a different carbon chain length is, for example, as follows.

| | |
|---|---|
| $C_{13}$-n-alkane sulfonate | 5% |
| $C_{14}$-n-alkane sulfonate | 16% |
| $C_{15}$-n-alkane sulfonate | 30% |
| $C_{16}$-n-alkane sulfonate | 30% |
| $C_{17}$-n-alkane sulfonate | 15% |
| $C_{18}$-n-alkane sulfonate | 4% |

The alkane sulfonates scarcely possess any toxic physiological action and are highly biodegradable, so they are excellent in controlling environmental pollution.

A first feature of this invention resides in that the combined use of at least two surface active agents selected from those of the general formulas (I) and (II) exhibits a superadditive and advantageous performance as compared with the individual use of each surface active agent. For example, when they are used in combination as a dispersing agent for couplers, an emulsified dispersion with more finely divided particles and greater stability is obtained. It has been known that when an anionic surface active agent and a nonionic surface active agent are used in combination, an excellent emulsified product of a photographic additive such as a coupler can be obtained as compared with the individual use of the anionic surface active agent, as described in, e.g., German OLS No. 1,942,873. However, it is not known hitherto that the combined use of at least two anionic surface active agents can provide super-additive effects to provide an emulsified product which is finely divided and stable with time. A suitable proportion of the surface active agents of the general formula (I) and/or the general formula (II) is at least about 1% by weight, preferably at least 10% by weight. The surface active agents according to this invention can be also used together with a nonionic surface active agent. These nonionic surface active agents include those containing alkylene oxide units. Suitable examples of nonionic surface active agents are described in U.S. Pat. No. 3,676,141 and U.S. Pat. application Ser. No. 283,026, filed Aug. 23, 1972 now U.S. Pat. No. 3,860,425.

A second feature of this invention resides in that the secondary alkane sulfonate of the general formula (I) exhibits superior performance to that of the primary alkane sulfonate of the general formula (II) having the same number of carbon atoms.

A third feature of this invention resides in that the secondary alkane sulfonate and the primary alkane sulfonate, when mixed and used, exhibit an even enhanced performance. The aforesaid Hostpur SAS displays very excellent performance in the emulsification of a photographic additive such as a coupler, the coating of a light-sensitive colloid layer, and the preparation of a solution in which a sensitizing dye, an antifogging agent and a stabilizing agent are solubilized.

The surface active agents of this invention are preferably used as a dispersing agent for couplers. The couplers used include compounds which can form color by color development with an aromatic primary amino developing agent such as phenylenediamine derivatives or aminophenol derivatives. Examples of couplers are 5-pyrazolone couplers, cyanoacetylcoumarone couplers, open-chain acylacetonitrile couplers, acylacetamide couplers (such as the benzoylacetanilides and the pivaloylacetanilides), naphthol couplers and phenol couplers.

More specifically, examples of magenta couplers are 5-pyrazolone couplers, cyanoacetylcoumarone couplers and indazolone couplers. Particularly useful couplers are those represented by the following general formula (III).

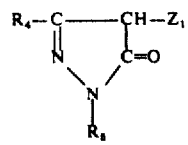

(III)

In the above formula, $R_4$ represents an alkyl group selected from primary, secondary and tertiary alkyl groups (such as methyl, propyl, n-butyl, t-butyl, hexyl, 2-hydroxyethyl, 2-phenylethyl, pentadecyl, etc.), an aryl group (such as phenyl, 2,4-di-tert-phenyl, etc.), a heterocyclic ring (such as quinolinyl, pyridyl, benzofuranyl, oxazolyl, etc.), an amino group (such as methylamino, diethylamino, phenylamino, tolylamino, 4-(3-sulfobenzamino)anilino, 2-chloro-5-acylaminoanilino, 2-chloro-5-alkoxycarbonylanilino or 2-trifluoromethylphenylamino, etc.), a carbonamido group (such as alkylcarbonamido such as ethylcarbonamido, arylcarbonamido, heterocyclic carbonamido such as benzothiazolylcarbonamido, sulfonamido, alkylsulfonamido, arylsulfonamido or heterocyclic sulfonamido), a ureido group (such as alkylureido, arylureido or heterocyclic ureido), an alkoxy group (such as methoxy, ethoxy, benzyloxy, etc.), an aryloxy group (such as phenoxy, etc.) or the like, and $R_5$ represents a hydrogen atom, an aryl group (such as naphthyl, phenyl, 2,4,6-trichlorophenyl, 2-chloro-4,6-dimethylphenyl, 2,6-dichloro-4-methoxyphenyl, 4-methylphenyl, 4-acylaminophenyl, 4-alkylaminophenyl, 4-trichloromethylphenyl or 3,5-dibromophenyl), a heterocyclic group (such as benzofuranyl, naphthoxazolyl or quinolinyl), an alkyl group selected from a primary, secondary or tertiary alkyl group (such as ethyl or benzyl) or the like. $Z_1$ represents a hydrogen atom or a group capable of being split off during color development, for example, an acyloxy group, an aryloxy group, a halogen atom, a thiocyano group, a di-substituted amino group, an aryloxycarbonyloxy group, an alkoxycarbonyloxy group, a benzotriazolyl group, an indazolyl group, an arylazo group or a heterocyclic azo group. These groups are described in, e.g., U.S. Pat. Nos. 3,227,550; 3,252,924; 3,311,476 and 3,419,391, U.S. patent application Ser. No. 461,204, filed Apr. 15, 1974, and 471,639, filed May 20, 1974. Moreover, $Z_1$ also includes a residue which releases a development retarder during the development, for example, an arylmonothio group (such as a 2-aminophenylthio or 2-hydroxycarbonylphenylthio group), a heterocyclic monothio group (such as a tetrazolyl, triazinyl, triazolyl, oxazolyl, oxadiazolyl, diazolyl, thiazyl or thiadiazolyl group), a heterocyclic imido group (such as a 1-benzotriazolyl, 1-indazolyl or 2-benzotriazolyl group) or the like, as described in, e.g., U.S. Pat. Nos. 3,148,062; 3,227,554; 3,615,506 and 3,701,783.

Examples of yellow couplers are open-chain acylacetamide couplers (such as a pivaloylacetanilide coupler or a benzoylacetanilide coupler) and open-chain acylacetonitrile couplers. Particularly useful are those couplers represented by the following general formula (IV).

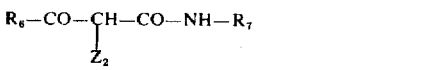

$$R_6-CO-\underset{\underset{Z_2}{|}}{CH}-CO-NH-R_7 \qquad (IV)$$

In the above formula, $R_6$ represents a primary, secondary or tertiary alkyl group having 1 to 18 carbon atoms (such as t-butyl, 1,1-dimethylpropyl or 1,1-dimethyl-1-methoxyphenoxymethyl), an aryl group (such as phenyl, alkylphenyl such as 3-methylphenyl, 3-octadecylphenyl, etc., alkoxyphenyl such as 2-methoxyphenyl, 4-methoxyphenyl, etc., halophenyl, 2-halo-5-alkamidophenyl, 2-chloro-5-[α-(2,4-di-t-amylphenoxy)butyramido]phenyl, 2-methoxy-5-alkylamidophenyl or 2-chloro-5-sulfonamidophenyl), an amino group (such as anilino, p-methoxyanilino or butylamino group), and $R_7$ represents aryl group (such as 2-chlorophenyl, 2-halo-5-alkamidophenyl, 2-chloro-5-[α-(2,4-di-t-amylphenoxy)acetamido]-phenyl, 2-chloro-5-(4-methylphenylsulfonamido)phenyl or 2-methoxy-5-(2,4-di-t-amylphenoxy)acetamidophenyl). $Z_2$ represents a hydrogen atom or a group capable of being split off during color development, for example, a halogen atom, particularly, a fluorine atom, an acyloxy group, an aryloxy group, an aromatic heterocyclic carbonyl group, an oxy group, a sulfimido group, an alkylsulfoxy group, an arylsulfoxy group, a phthalimido group, a dioxoimidazolidinyl group, a dioxooxazolidinyl group, an indazolyl group, or a dioxothiazolidinyl group. These groups are described in, for example, U.S. Pat. Nos. 3,227,550; 3,253,924; 3,277,155; 3,265,506; 3,408,194 and 3,415,652; French Patent No. 1,411,384; British Patent Nos. 994,490; 1,040,710 and 1,118,028; and German OLS Nos. 2,057,941; 2,163,812; 221,346 and 2,219,971. Moreover, $Z_2$ can represent a residue which releases a development retarder, for example, an arylmonothio group (such as a phenylthio or 2-carboxyphenylthio group), a heterocyclic thio group, a 1-benzotriazolyl group or a 1-benzodiazolyl group and, particularly a residue as described in U.S. patent application Ser. No. 454,525, filed Mar. 25, 1974.

Examples of cyan couplers are naphthol couplers and phenol couplers. Particularly, couplers represented by the following general formulas (V) and (VI) are useful.

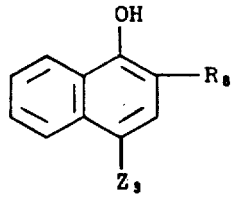

(V)

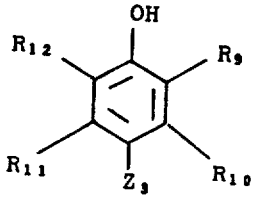

(VI)

In the above formulas, $R_8$ represents a substituent generally used for cyan couplers, for example, a carbamyl group (such as alkylcarbamyl, arylcarbamyl such as phenylcarbamyl, or heterocyclic carbamyl such as benzothiazolylcarbamyl), a sulfamyl group (such as alkylsulfamyl, arylsulfamoyl such as phenylsulfamyl, or heterocyclic sulfamyl), and alkoxycarbonyl group, an aryloxycarbonyl group, etc. $R_9$ represents an alkyl group, an aryl group a heterocyclic group, an amino group (such as an amino, alkylamino or arylamino group), a carbonamido group (such as alkylcarbonamido or arylcarbonamido), a sulfonamido group, a sulfamyl group (such as alkylsulfamyl or arylsulfamyl), a carbamyl group, etc. $R_{10}$, $R_{11}$ and $R_{12}$ each represents the same groups as defined for $R_9$, and also a halogen atom, an alkoxy group, etc. $Z_3$ represents a hydrogen atom or a group capable of being split off during color development. $Z_3$ has the same meanings as defined for $Z_2$. Moreover, $Z_3$ represents a halogen atom such as chlorine, bromine or iodine atom, a thiocyano group or a group such as indazolyl, cyclic imido (e.g., maleimido, succinimido, 1,2-dicarboxyimido), acyloxy, aryloxy, alkoxy, sulfo, arylazo or heterocyclic azo. Examples of these groups are described in, for instance, U.S. Pat. Nos. 2,423,730; 3,227,550 and 3,311,476; and British Patent Nos. 1,084,480 and 1,165,563.

The couplers used in this invention can also be colored couplers. Colored couplers are described in, for example, U.S. Pat. Nos. 2,983,608; 3,005,712 and 3,034,892; British Patent Nos. 936,621; 1,269,073; 586,211 and 627,814; and French Patent Nos. 980,372; 1,091,903; 1,257,887; 1,398,308 and 2,015,649.

It is advantageous to render the couplers used in this invention diffusion resistant. In order to render the couplers diffusion resistant, a group containing a hydrophobic residue with 8 to 32 carbon atoms is introduced into the molecule of the coupler. Such a residue is referred to as a ballast group. The ballast group can be attached to a skeleton structure of the coupler directly or through, for example, an imino bond, an ether bond, a carbonamido bond, a sulfonamido bond, a ureido bond, an ester bond, an imido bond, a carbamoyl bond or a sulfamoyl bond.

Typical examples of ballast groups are those as described in illustrative examples of couplers used in this invention given hereinafter.

Illustrative examples of ballast groups are given below

I. Alkyl groups and alkenyl groups for example, $-CH_2-CH(C_2H_5)_2$, $-C_{12}H_{25}$, $-C_{16}H_{33}$, $-C_{17}H_{33}$ II. Alkoxyalkyl groups, for example, $-(CH_2)_3-O-(CH_2)_7CH_3$, $$-(CH_2)_3OCH_2-\underset{\underset{C_2H_5}{|}}{CH}-(CH_2)_6-CH_3$$

as described in Japanese Patent Publication No. 27,563/64.

III. Alkylaryl groups, for example,

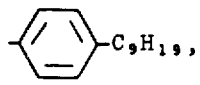

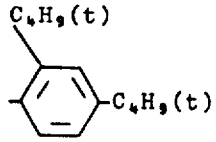

IV. Alkylaryloxyalkyl groups, for example,

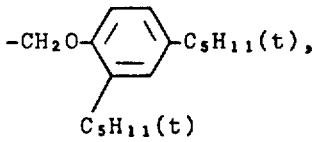

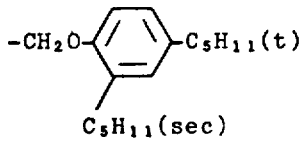

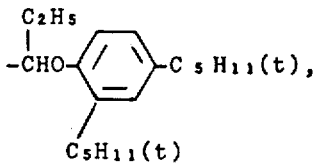

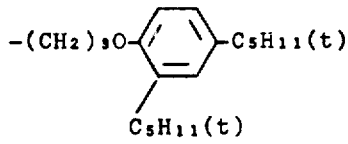

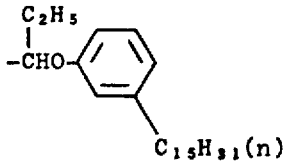

,

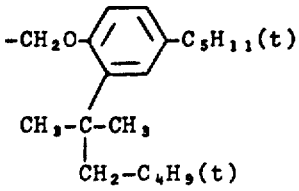

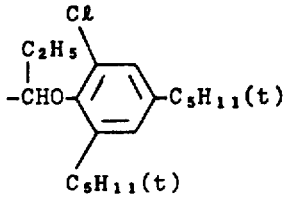

V. Acylamidoalkyl groups, for example,

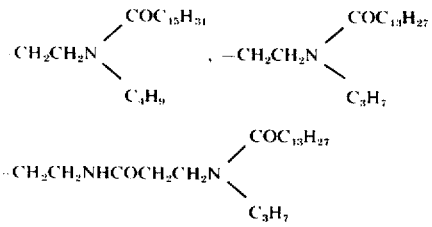

as described in U.S. Pat. Nos. 3,333,344 and 3,418,129.

VI. Alkoxyaryl and aryloxyaryl groups, for example,

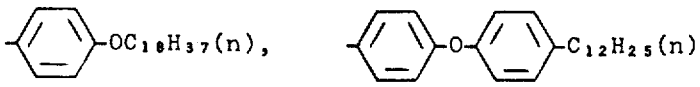

VII. Residues having long chain alkyl or alkenyl aliphatic group together with a carboxyl or sulfo group which provides water solubility, for example,

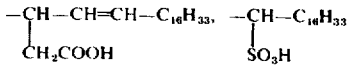

VIII. Alkyl groups substituted with an ester group, for example,

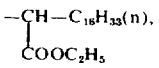

$-CH_2-CH_2-COOC_{12}H_{25}(n)$

IX. Alkyl groups substituted with an aryl or heterocyclic group, for example,

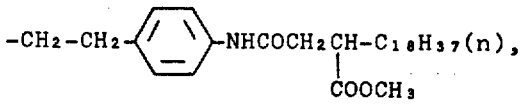

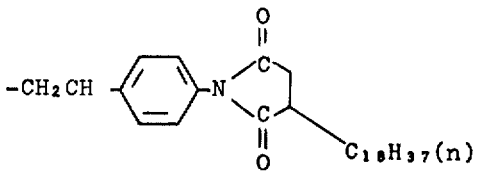

X. Aryl groups substituted with an aryloxyalkoxycarbonyl group, for example,

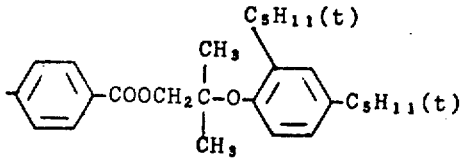

Illustrative examples of couplers which can be used in this invention are given below but the invention is not to be interpreted as being limited to these examples.

Yellow Couplers

1. α-{3-[α-(2,4-Di-tert-amylphenoxy)butyramido]-benzoyl}-2-methoxyacetanilide
2. α-Acetoxy-α-3-[γ-(2,4-di-tert-amylphenoxy)-butyramido]-benzoyl-2-methoxyacetanilide
3. N-(4-Anisoylacetamidobenzenesulfonyl)-N-benzyl-N-toluidine
4. α-(2,4-Dioxo-5,5-dimethyloxazolidinyl)-α-pivaloyl-2-chloro-5-[α-(2,4-di-tert-amylphenoxy)-butyramido]acetanilide
5. α-(4-Carboxyphenoxy)-α-pivaloyl-2-chloro-5-{α-(2,4-di-tertamylphenoxy)butyramido}acetanilide
6. α-(5 or 6-Methyl-1-benztriazolyl)-α-(N-4-methoxyphenylcarbamoyl-2-methoxy-5-[α-(2,4-di-tert-amylphenoxy)-butyramido]acetanilide
7. α-Benzoyl-α-(2-benzothiazolylthio)-4-[N-(γ-phenylpropyl)-N-(4-tolyl)sulfamyl]acetanilide
8. α-Pivaloyl-α-(5 or 6-bromo-1-benztriazolyl)-5-[α-(2,4-ditert-amylphenoxy)propionamido]-2-chloroacetanilide Magenta Couplers 9. 1-(2,4,6-Trichlorophenyl)-3-[3-(2,4-di-tert-amylphenoxyacetamido)benzamido]-5pyrazolone
10. 1-(2,4,6-Trichlorophenyl)-3-{3-[α-(2,4-di-tert-amylphenoxy)-acetamido]benzamido}-4-acetoxy-5-pyrazolone
11. 1-(2,4,6-Trichlorophenyl)-3-tridecylamido-4-(4-hydroxyphenyl)-azo-5-pyrazolone
12. 1-(2,4,6-Trichlorophenyl)-3-[(3-tridecanoylamino-6-chloro)-anilino]-5-pyrazolone
13. 1-(2,4,6-Trichlorophenyl)-3-(3-tetradecyloxycarbonyl-6-chloro)anilino-4-(1-naphthylazo)-5-pyrazolone
14. 1-(2,4-Di-chloro-6-methoxyphenyl)-3-[(3-tridecanoylamino-6-chloro)anilino]-4-benzyloxycarbonyloxy-5-pyrazolone
15. 1-14-[γ-(2,4-Di-tert-amylphenoxybutyramido)-phenyl]-3-piperidinyl-4-(1-phenyl-5-tetrazolylthio)-5-pyrazolone
16. 1-Benzyl-3-{4-[α-(2,4-di-tert-amylphenoxy)-butyramido]-anilino}-4-(5 or 6-bromo-1-benztriazolyl)-5-pyrazolone
17. 1-[4-{α-(2,4-Di-tert-amylphenoxy)acetamido-}phenyl]-3-ethoxy-4-(5 or 6-bromo-1-benztriazolyl)-5-pyrazolone Cyan Couplers 18. 1-Hydroxy-N-[γ-(2,4-di-tert-amylphenoxy-propyl)]-2-naphthamide
19. 1-Hydroxy-4-[2-(2-hexyldecyloxycarbonyl)-phenylazo]-2-[N-(1-naphthyl)]naphthamide
20. 1-Hydroxy-4-chloro-N-[α-(2,4di-tert-amylphenoxy)butyl]-2-naphthamide
21. 5-Methyl-4,6-dichloro-2-[α-(3-n-pentadecylphenoxy)-butyramido]phenol 22. 1-Hydroxy-4-iodo-N-dodecyl-2-naphthamide 23. 5-Methoxy-2-[α-(3-n-pentadecylphenoxy)-butyramido]-4-(1-phenyl-5-tetrazolylthio)phenol Non Coloring Coupler 24. N-{α-(2,4-Di-tert-amylphenoxy)acetyl}-ω-(1-phenyl-5-tetrazolylthio)-m-aminoacetophenone A fading inhibitor for a colored dye image (for example, as described in U.S. Pat. Nos. 3,764,337 and 3,432,300 and German OLS No. 2,146,668) can also be dispersed together with the coupler using the surfactant according to this invention.

The surface active agents of this invention can be applied to the dispersion of other photographic additives.

An antioxidant which can be used in this invention includes phenol and hydroquinone derivatives having aliphatic group of 8 or more carbon atoms or precursors thereof, for example, as described in U.S. Pat. Nos. 2,336,327; 2,728,659; 2,835,579 and 3,700,453.

A filter dye which can be used in this invention includes hydrophobic oxonol dyes, benzotriazole ultraviolet absorbants and benzophenone ultraviolet absorbants, for example, as described in U.S. Pat. Nos. 3,253,921; 3,533,794; 3,794,493; 3,785,827 and 3,707,375, etc. Moreover, as the antioxidant for a colored dye image, the compounds described in U.S. Pat. Nos. 3,432,300 and 3,764,337 and German OLS No. 2,146,668 are particularly useful.

Among all, the compounds represented by the following general formulas (VII), (VIII) and (IX) are preferred.

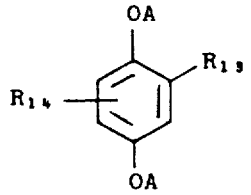

(VII)

In the above formula (VII), $R_{13}$ represents a straight or branched chain alkyl group with 8 to 20 carbon atoms such as n-octyl, tert-octyl, dodecyl, octadecyl, etc., and $R_{14}$ represents a hydrogen atom or a straight or branched alkyl group with 8 to 20 carbon atoms such as n-octyl, tert-octyl, dodecyl, octadecyl, etc. A represents a hydrogen atom or a group capable of being split off by alkali (such as an acyl group such as an acetyl group or an alkoxycarbonyl group). The benzene ring can be further substituted with an alkyl group having up to 8 carbon atoms such as methyl, butyl, octyl, etc., a halogen atom such as chlorine, etc. or the like.

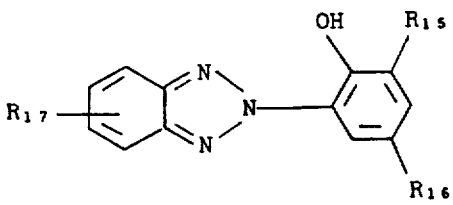

(VIII)

In the above formula (VIII), $R_{15}$ and $R_{16}$ each represents a hydrogen atom or an alkyl group having up to 5 carbon atoms such as methyl, ethyl, iso-propyl, n-butyl, sec-butyl, t-butyl, amyl, etc., and $R_{17}$ represents a hydrogen atom, an alkoxy group, e.g., having 1 to 6 carbon atoms such as methoxy, etc., or a halogen atom such as chlorine, bromine, etc.

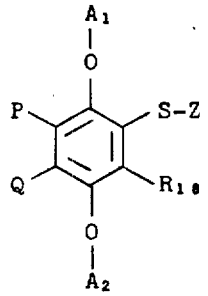

(XI)

In the above formula $A_1$ and $A_2$ is a hydrogen atom or a group removable with an alkali, such as an alkoxycarbonyl group, an acyl group, etc., and $A_2$ can combine with $R_{18}$ or Q to form a ring such as an oxathiol group; P, Q or $R_{18}$ each is a hydrogen atom, an alkyl group, e.g., methyl, ethyl, 1,1,3,3-tetramethylbutyl, n-pentadecyl, an —S—Y group (wherein Y is an alkyl group, e.g., 2-ethyl-hexyl, n-dodecyl, n-hexadecyl, n-octadecyl, hydroxycarbonylmethyl, ethoxycarbonylmethyl, 2-hydroxyethyl, etc., or an aryl group, e.g., phenyl, tolyl, etc.), octyl, tridecyl, allyl, etc., an aryl group, e.g., phenyl, p-tolyl, etc., a hydroxyl group, a halogen atom, an —S—Z group, an alkoxy group, e.g., methoxy, ethoxy, etc., an aryloxy group, an —O—Y group, etc., or a hetero ring; and Z is a heterocyclic ring which is substantially photographically inert in a bonded condition and particularly is a tetrazolyl group, e.g., 1-phenyltetrazolyl, etc., a triazolyl group, e.g., 4-phenyl-1,2,4-triazole-5-yl, 3-n-pentyl-4-phenyl, 1,2,4-triazole-5-yl, etc., a thiadiazolyl group, e.g., 2-methylthio-1,3,4-thiadiazole-5-yl, 2-amino-1,3,4-thiadiazole-5-yl, etc., an oxadiazolyl group, e.g., 2-phenyl-1,3,4-oxadiazole-5-yl, etc., a tetraazaindenyl group, e.g., 6-methyl-1,3,3a,7-tetraazaindene-4-yl, 6-n-nonyl-1,3,3a,7-tetraazaindene-4-yl, etc., an oxazolyl group, e.g., benzooxazole-2-yl, etc., a thiazolyl group, e.g., benzothiazole-2-yl, etc., etc. In particular, of P, Q and $R_{18}$, $R_{18}$ can be an —S—Z group. Preferably, P, Q or $R_{18}$ contains a ballast group in its chemical structure and at least one of P, Q and $R_{18}$ is a Y—S— group.

Suitable high boiling solvents which can be employed include phosphoric acid esters such as tricresyl phosphate, phthalic acid esters such as dibutylphthalate, N-di-alkyl substituted alkylamides such as N,N-diethyl-lauramide, glycerol esters such as glycerol triacetate, citric acid esters such as acetyl tri-n-butyl citrate, succinic acid esters such as tetrahydrofurfuryl succinate or the like. Specific examples are described in, e.g., U.S. Pat. Nos. 2,322,027; 2,533,514 and 3,287,134, German Patent No. 1,152,610, British Patent No. 1,272,561, Japanese Patent Publication No. 21,766/68, U.S. Pat. application Ser. No. 485,655, filed July 3, 1974.

The high boiling solvent used in this invention can be used together with a substantially water-insoluble low boiling auxiliary solvent such as methyl acetate, ethyl acetate and butyl acetate or a water-soluble organic auxiliary solvent such as methyl isobutyl ketone, β-ethoxyethyl acetate, methyl carbitol, methyl cellosolve, dipropylene glycol, dimethylformamide and dioxane. Such solvents are described in, for example, U.S. Pat. Nos. 2,801,170; 2,801,171; 2,949,360 and 2,835,579. The auxiliary solvents can be removed by washing with water as described in U.S. Pat. Nos. 2,801,171; 2,949,360 and 3,396,027; or by volatilizing as described in U.S. pat. Nos. 2,322,027 and 2,801,171 or German OLS No. 2,045,464.

A solution containing organic photographic additives such as couplers, the antioxidant and the filter dye dissolved in the high boiling solvent used in this invention alone or in combination with the auxiliary solvent can be dispersed in an aqueous solution of a hydrophilic colloid, particularly, gelatin. Suitable dispersion methods which can be used are described in, e.g., U.S. Pat. Nos. 2,304,939; 2,322,027; 2,801,170; 2,801,171 and 2,949,360.

The surface active agents of this invention can be also employed in the preparation of an aqueous solution in which a sensitizing dye, a stabilizing agent and an antifogging agent are solubilized. For example, they are particularly useful for the solubilization of substances as described in U.S. Pat. No. 3,822,135. They are also especially useful for sensitizing dyes containing, in the dye molecule, an alkylene or substituted alkylene group with a water-solubilizing group such as a sulfo, carboxyl or hydroxyl group as described in F.M. Hamer, *The Cyanine Dyes and Related Compounds* Vol. 1, Interscience Publishers (1964).

The surface active agents used in this invention can be also employed in the coating of a silver halide emulsion.

When the above-described dispersion of photographic additives is added to a silver halide emulsion, the surface active agents of this invention used for the dispersion of the additives act also as a coating aid.

The silver halide photographic emulsions which can be used in the present invention include any known silver halide emulsion such as a silver bromide emulsion, a silver iodobromide emulsion, a silver chloroiodobromide emulsion, a silver chloride emulsion, and a silver chlorobromide emulsion or a silver halide emulsion of the so-called conversion halide type as described in, e.g., U.S. Pat. Nos. 2,592,250 and 3,622,318 and British Patent No. 635,841. The silver halide grains can be of any size generally used in the photographic art but preferably have a grain size from about 0.02 to 5 microns, more preferably 0.1 to 2 microns.

Also, examples of the hydrophilic colloid which can be used for the coupler dispersion and the silver halide photographic emulsion are gelatin; a gelatin derivative such as acylated gelatin as described in U.S. Pat. No. 2,525,753, etc., graft gelatin as described in U.S. Pat. No. 2,831,767, etc.; albumin; gum arabic; agar agar; a cellulose derivative such as acetyl cellulose, hydroxyethyl cellulose, carboxymethyl cellulose, etc.; and a synthetic resin such as polyvinyl alcohol, polyvinyl pyrrolidone, polyacrylamide, etc.

The silver halide emulsion can be chemically sensitized using active gelatin or a sulfur compound as described in U.S. Pat. Nos. 1,574,944; 1,623,499; 2,410,689; etc. Also, the emulsion can be sensitized using a salt of a noble metal such as palladium, gold, ruthenium, rhodium, platinum, etc., as described in U.S. Pat. Nos. 2,448,060; 2,399,083; 2,642,361; etc. Furthermore, the silver halide emulsion can be sensitized using a reducing agent such as a stannous salt, as described in U.S. Pat. No. 2,487,850, and also can be sensitized using a polyalkylene oxide derivative. Moreover, the silver halide emulsion can be spectrally sensitized with a cyanine dye or a merocyanine dye, as disclosed in U.S. Pat. Nos. 2,519,001; 2,666,761; 2,734,900; 2,739,964; 3,481,742; etc. Typical examples of sensitizing dyes include dyes such as anhydro-9-methyl-5,5'-dimethyl-3,3'-di-(3-sulfopropyl)benzoselenacarbocyanine, 5,5'-dichloro-9-ethyl-di-(2-hydroxyethyl)thiacarbocyanine.bromide or anhydro-5,5'-diphenyl-9-ethyl-3,3'-di-(2sulfoethyl)benzoxazolocarbocyanine.hydroxide.

The silver halide emulsion can further contain a stabilizer such as a mercury compound, an azaindene, etc., as described in U.S. Pat. Nos. 2,886,437; 2,444,605; 2,403,927; 3,266,877; 3,397,987; etc., a plasticizer such as glycerine as described in C. E. K. Mees and T. H. James *The Theory of Photographic Process*, page 53 – 54, The Macmillan Co., New York (1966), and U.S. Pat. Nos. 2,904,434; 2,940,854; etc., an antifogging agent such as a mercapto compound or a benzotriazole derivative, a sensitizer such as an onium derivative, for example, the quaternary ammonium salts as described in U.S. Pat. Nos. 2,271,623; 2,288,266 and 2,334,864 or the polyalkylene oxide derivatives as described in U.S. Pat. Nos. 2,708,162; 2,531,832; 2,533,990; 3,210,191 and 3,158,484, etc. In addition, an anti-irradiation dye can be incorporated in the emulsion. Moreover, a filter layer, a mordant dyeing layer or a colored layer containing a hydrophobic dye can be employed as the elements constituting layers of the color light-sensitive material of this invention.

The photographic light-sensitive material of the present invention comprises a support having thereon at least one emulsion layer containing the combination of surface active agents of the present invention.

As the support, examples are a cellulose ester film such as a cellulose nitrate film, a cellulose acetate film, etc.; a polyester film such as a polyethylene terephthalate film, etc., a polyvinyl chloride film, a polystyrene film, a polycarbonate film, a paper, a so-called baryta-coated paper prepared by coating barium sulfate on a paper support, a laminate film prepared by coating a cellulose ester, a polyester, a polyvinyl chloride, a polystyrene, or a polycarbonate on a paper or a baryta-coated paper, and a synthetic paper. A suitable coating amount of the silver halide can range from about $4 \times 10^{-4}$ to $4 \times {}^{-2}$, preferably $2 \times 10^{-3}$ to $2 \times 10^{-2}$, mol/m$^2$.

The photographic material of the present invention can have in addition to the above-described silver halide emulsion layers, other layers conventionally employed for constituting the photographic material, such as, for instance, a protective layer, a filter layer, an intermediate layer, an antihalation layer, a subbing layer, a backing layer, a layer containing an ultraviolet absorber, etc. Also, as the binders for these layers, the hydrophilic colloid used for the silver halide emulsion layers can be employed.

Each layer of the photographic material of the present invention can contain a hardening agent for the hydrophilic colloid. Typical examples of such hardening agents are aldehyde type compounds such as formaldehyde, glyoxal, succinaldehyde, glutaraldehyde, 2,3-dihydroxy-1,4-dioxane, mucochloric acid, dimethylolurea, etc.; active vinylic compounds such as divinylsulfone, methylene bismaleimide, 5-acetyl-1,3-diacryloyl-1,3,5-hexahydrotriazine, N,N',N'-triacryloyl-1,3,5-hexahydrotriazine, etc.; active halogen compounds such as 2,4-dichloro-6-oxytriazine sodium salt, 2,4-dichloro-6-methoxytriazine, sebacic acid bis-chloromethyl ester, N,N'-bis(α-chloroethylcarbamyl)-piperazine, etc.; epoxy compounds such as bis(2,3-epoxypropyl)methylpropyl ammonium para-toluene sulfonate, 1,4-bis(2',3'-epoxypropyloxy)butane, 1,3-diglycidyl-5-(γ-acetoxy-β-oxypropyl)isocyanurate, etc.; ethyleneiminic compounds such as 2,4,6-triethyleneimino-1,3,5-triazine, bis-β-ethylene-iminoethyl thioether, etc.; and methane sulfonate compounds such as 1,2-di(methanesulfonyloxy)ethane, 1,4-di(methanesulfonyloxy)butane, 1,5-di(methanesulfonyloxy)-pentane, etc., as described in U.S. Pat. Nos. 3,232,764; 3,288,775; 2,732,303; 3,635,718; 3,232,763; 2,732,316; 2,586,168; 3,103,437; 3,017,280; 2,783,611; 2,725,294; 2,725,295; 3,100,704; 2,091,537; 3,321,313; etc.

Further each layer of the photographic material can contain an antistatic agent as described in U.S. Pat. Nos. 2,739,888; 3,428,456; 3,437,484; 3,457,076; 3,549,375; 3,549,369; 3,551,152; 3,552,972; 3,547,643; 3,564,043; 3,615,531; 3,625,695; 3,655,287; 3,653,906; 3,655,386; 3,686,368; 3,756,828; 3,754,924; etc., an ultraviolet absorber as described in U.S. Pat. Nos. 2,415,624; 3,052,636; 3,074,971, 3,085,097; 3,067,456; 3,215,536; 2,719,086; 2,537,877; 2,784,087; 2,882,150; 2,875,053; 2,739,971; 3,097,100; 3,060,029; 2,632,701; 2,858,346; 2,748,021; etc., a fluorescent whitening agent as described in U.S. Pat. Nos. 3,630,738; 3,615,544; 3,586,673; 3,434,837; British Patent Nos. 1,332,475; 1,319,763; 1,333,586; etc., an anti-irradiation dye as disclosed in U.S. Pat. No. 3,445,231, etc.

In forming black-white silver images or color images, the photographic light-sensitive material of this invention can be processed using a developer which can reduce silver halide particles to silver. In the case of black-white development, a developer containing as a developing agent a polyhydroxybenzene, an N-alkylaminophenol, a 1-phenyl-3-pyrazolidone or a mixture thereof can be used. Examples of polyhydroxybenzenes are hydroquinone, pyrocatechol or pyrogallol, and examples of N-alkylaminophenols are N-methylaminophenol or N-ethylaminophenol. Examples of 1-phenyl-3-pyrazolidones are 1-phenyl-3-pyrazolidone or 1-phenyl-4,4-dimethyl-3-pyrazolidone. In subjecting the color photographic light-sensitive material obtained according to this invention to color development, a developer containing as a developing agent a p-phenylenediamine derivative such as 4-amino-N,N-diethylaniline, 4-amino-3-methyl-N-methyl-N-(β-methylsulfonamidoethyl)aniline, 4-amino-3-methyl-N-ethyl-N-(β-hydroxyethyl)aniline, 4-hydroxyaniline or 4-hydroxy-2,6dibromoaniline can be used.

The photographic light-sensitive material of this invention can be processed at usual processing temperatures, i.e., at about 20° to 30°C, and can also be processed at higher temperatures, i.e., at about 30° to 60°C or more.

Preferred processing steps for the color light-sensitive material of this invention are those steps as described in, for example, Japanese Patent Publication No. 35,749/70, Japanese Patent Application Nos. 67,798/69, 13,313/71 and 19,516/71, and further in H. Gordon *The British Journal of Photography* pp. 558 et seq., Nov. 15, 1954, ibid., pp. 440 et seq., Sept. 9, 1955 and ibid., pp. 2 et seq., Jan. 6, 1956, in S. Horwitz, ibid., pp. 212 et seq., Apr. 22, 1960, in E. Gehret, ibid., pp. 122 et seq., Mar. 4, 1960, and ibid., pp. 396 et seq., May 7, 1965, in J. Meech, ibid., pp. 182 et seq., Apr. 3, 1959, and German Patent OLS No. 2,238,051.

The surface active agents of this invention have scarcely any toxic physiological effects and are highly biodegradable. In addition, many measures must be taken in the development processing step for removing or decreasing factors causing environmental pollution. At first, benzyl alcohol having a development accelerating effect contained in a color developer contributes to increasing the biochemical oxygen demand (BOD). When the surface active agent used in this invention is employed together with couplers, particularly, those in which a hydroxyl group or, preferably, a carboxylic acid group or a sulfo group is introduced in the ballast group and in the group capable of being split off (for example, $Z_1$, $Z_2$ and $Z_3$ in the aforesaid formulas (III), (IV), (V) (VI)), a satisfactory rapid development rate is obtained and excellent color images can be obtained without benzyl alcohol in the developer. Next, ferricyanide or ferrocyanide provides a source of toxic cyanide a ion and the chelating agent of the metal salt oxidant is a factor rendering waste-water treatment difficult. In the color photographic light-sensitive material prepared using the surface active agents used in this invention, the formed silver image or reduced silver tends to be easily bleached. Thus, an advantageous countermeasure to environmental pollution caused by a bleaching solution is obtained. The color photographic light-sensitive material of this invention has an oxidation-reduction potential (Eredox), as defined hereinafter, of about -150 mv to 1000 mv, contains halide ion and can be bleached as to silver using a bleaching solution containing a metal salt or an organic oxidant. Suitable metal salts are salts of transition metals, particularly, salts of $Ti^{4+}$, $V^{5+}$, $Cr^{6+}$, $Mn^{7+}$, $Cu^{2+}$, $Fe^{3+}$ or $Co^{3+}$, or the complex salts thereof, and examples of organic oxidants are p-sulfophenylquinone, sulfonaphthoquinone, Breuster blue radical and Weitz radical, as described in, for example, U.S. Pat. Nos. 2,507,183; 2,529,981; 2,625,477; 2,748,000; 2,810,648 and 2,705,201, British Patent Nos. 1,111,313; 777,635; 1,032,024; 1,014,396 and 982,984, and Japanese Patent Publication Nos. 14,035/70 and 13,944/67.

The "Eredox" used in this specification is defined as the value which is determined in the following manner.

The value is measured using a composite platinum electrode (EA-216 type, manufactured by Metrohm Ltd.) with a silver/silver chloride electrode as a reference electrode and a potentiometer (E-436 manufactured by Metrohm Ltd.) at 25°C±0.2°C.

This invention is explained in greater detail by reference to the following examples. Unless otherwise indicated, all parts, percents, ratios and the like are by weight.

EXAMPLE 1

100 g of Cyan Coupler (21) was dissolved in 200 ml of ethyl acetate and 200 ml of dibutyl phthalate, to which 4 g of sorbitan monolaurate was added and dissolved therein. On the other hand, each of the surface active agents shown in Table 1 below was added to a 10% aqueous solution of gelatin and dissolved therein. Each solution was mixed with the coupler solution, and each sample was emulsified using a high-speed rotary mixer under the same conditions to obtain a dispersion.

A predetermined amount of the dispersion was removed and the number average particle size of the dispersed oily drops was determined by analyzing the light wavelength dependence of the light scattering of the emulsified product of the coupler. Basically, this method is based on the principle described in R. J. Gledhill, et al., *Journal of the Optical Society of America* Vol. 53, pp. 239 to 246 (1963).

The number average particle size of the oily drops was measured for the resulting dispersion immediately after the production and after standing for 14 days at 5°C. The data obtained are shown in Table 1.

TABLE 1

| Run No. | Surface Active Agent(g) | | Average Particle Size (μ) After Production | After 14 Days |
|---|---|---|---|---|
| 1 | Sodium Dodecylbenzene-sulfonate | 4 | 0.20 | 0.21 |
| 2 | $C_{14}$-n-Alkane Sulfonate | 4 | 0.22 | 0.38 |
| 3 | $C_{16}$-n-Alkane Sulfonate | 4 | 0.22 | 0.40 |
| | $C_{14}$-n-Alkane Sulfonate | 2 | | |
| 4 | $C_{16}$-n-Alkane Sulfonate (mixture) | 2 | 0.18 | 0.20 |
| 5 | $C_{16}$-2-Alkane Sulfonate | 4 | 0.21 | 0.25 |
| 6 | Hostapur-SAS 60 | 4 | 0.18 | 0.19 |

Experimental data of Run Nos. 1, 2 and 3 in the above Table 1 are given for comparison.

The $C_{16}$-2-alkane sulfonate used for Run No. 5 had the following structure.

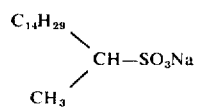

The composition of Hostapur SAS 60 used for Run No. 6 was:

| | |
|---|---|
| $C_{13}$-n-Alkane sulfonate | 3% |
| $C_{14}$-n-Alkane sulfonate | 25% |
| $C_{15}$-n-Alkane sulfonate | 30% |
| $C_{16}$-n-Alkane sulfonate | 25% |
| $C_{17}$-n-Alkane sulfonate | 15% |
| $C_{18}$-n-Alkane sulfonate | 2% |

The excellent effects due to the combination of surface active agents according to this invention can be seen from the results in Table 1 above.

EXAMPLE 2

100 g of Magenta Coupler (9) was dissolved in 200 ml of ethyl acetate and 50 ml of tricresyl phosphate, to which 4 g of sorbitan monolaurate was added and dissolved therein. The coupler solution was emulsified according to the manner as described in Example 1 to obtain a dispersion.

The number average particle size of the dispersion was measured in the same manner as described in Example 1 and the results shown in Table 2 were obtained.

TABLE 2

| Run No. | Surface Active Agent(g) | | Average Particle Size (μ) After Production | After 14 Days |
|---|---|---|---|---|
| 7 | Sodium Dodecylbenzene-sulfonate | 4 | 0.20 | 0.21 |
| 8 | $C_{16}$-n-Alkane Sulfonate | 4 | 0.38 | 0.40 |
| 9 | Hostapur-SAS 60 | 4 | 0.20 | 0.20 |

EXAMPLE 3

Emulsified couplers were obtained in the same manner as described in Example 2 except for the use of 100 g of Yellow Coupler (4). The number average particle size of the dispersion was measured in the same manner as described in Example 1 and the results shown in Table 3 were obtained.

TABLE 3

| Run No. | Surface Active Agent(g) | | Average Particle Size (μ) After Production | After 14 Days |
|---|---|---|---|---|
| 10 | Alkanol B | 4 | 0.26 | 0.28 |
| 11 | $C_{16}$-n-Alkane Sulfonate | 4 | 0.26 | 0.36 |
| 12 | Hostapur-SAS 60 | 4 | 0.22 | 0.22 |

EXAMPLE 4

To 1 kg of a silver chlorobromide emulsion (containing a silver amount of 0.52 mol/kg and a bromide content of about 93 mol%), 600 g of the emulsified product obtained in Run No. 10 in Example 3 was added, 10 cc of a 1% aqueous solution of 4-hydroxy-1,3,3a,7-tetrazaindene was added and 20 cc of a 1% aqueous solution of 2,4-dichloro-6-hydroxy-S-triazine.sodium salt was added, and the mixture was coated on a polyolefin-laminated paper at a coating rate of about 20 m/minute. Difficulty occurred due to poor wetting of the emulsion. Such difficulty was eliminated by adding 20 cc of a 1% aqueous solution of Hostapur-60 to the above emulsion.

A finished emulsion prepared in the same manner as described above except for the use of 600 g of the emulsified product obtained in Run No. 12 in place of the above emulsified product Run No. 10 was coated in the same manner. In this case, difficulties due to poor wetting occurred.

EXAMPLE 5

A light-sensitive material was prepared comprising, on a cellulose triacetate film, an antihalation layer containing black colloidal silver as a first layer, an intermediate layer as a second layer, a highly blue-sensitive layer containing the yellow coupler dispersion obtained in Run No. 12 in Example 3 as a third layer, a green-sensitive layer containing the magenta coupler dispersion obtained in Run No. 9 in Example 2 as a fourth layer, an intermediate layer as a fifth layer, a red-sensitive emulsion layer containing the cyan coupler dispersion obtained in Run No. 6 in Example 1 as a sixth layer, a yellow filter layer containing an emulsified product of a ultraviolet absorbant as a seventh layer and a protective layer as an eighth layer.

The composition of each light-sensitive layer is given below.

TABLE 4

| Component | Blue-Sensitive Layer (third layer) | Green-Sensitive Layer (fourth layer) | Layer Red-Sensitive Layer (sixth layer) | Intermediate Layer (second and fifth layers) | Protective Layer (eighth layer) |
|---|---|---|---|---|---|
| Silver Halide Emulsion (1 kg) | Silver bromoiodide (silver amount of 0.52 mol/kg, iodide of 6 mol%) | Silver bromoiodide (silver amount of 0.6 mol/kg, iodide of 6 mol%) | Silver bromoiodide (silver amount of 0.52 mol/kg, iodide of 4 mol%) | 7% Gelatin aqueous solution (1 kg) | 7% Gelatin aqueous solution (1 kg) |
| Sensitizing Dye | — | A. $4 \times 10^{-5}$ mol<br>B. $1 \times 10^{-5}$ mol | C. $2 \times 10^{-5}$ mol<br>D. $1 \times 10^{-5}$ mol | — | — |
| Stabilizing[1] Agent (1% solution) | 10 cc | 10 cc | 20 cc | — | — |
| Hardening[2] Agent | 20 cc | 20 cc | 30 cc | 50 cc | 50 cc |
| Hostapur-60 (1% aqueous solution) | — | 10 cc | 10 cc | 20 cc | 20 cc |
| Emulsified Product | Run No. 12 600 g | Run No. 9 400 g | Run No. 6 500 g | 2,5-Di-t-octylhydroquinone[3] 150 g | — |

[1]4-Hydroxy-1,3,3a,7-tetrazaindene
[2]2,4-Dichloro-6-hydroxy-S-triazine sodium salt
[3]A disperson prepared by mixing 100 g of 2,5-di-tert-octylhydroquinone; a solution containing 0.3 g of 2,3-dihydroxynaphthalene, 100 ml of butyl acetate and 100 ml of di-n-butyl phthalate; and a solution containing 5 g of Hostapur-SAS 60 and dissolved in 1 kg of 10% gelatin solution, and emulsifying them.
A. Anhydro-5,5'-dichloro-9-ethyl-3,3'-di-3-sulfopropyloxacarbocyanine
B. Anhydro-5,5',6,6'-tetrachloro-3,3'-di-sulfopropoxyethoxyethylbenzimidazolocarbocyanine
C. Anhydro-5,5'-dichloro-9-ethyl-3,3'-di-3-sulfobutylthiacarbocyanine
D. Anhydro-5,5'-dimethyl-9-methyl-3,3'-di-3-sulfopropylselenacarbocyanine The obtained light-sensitive material was subjected to optical wedge exposure using an exposure amount of 100 lux.second at a color temperature of 5,400°K and then to development processing in the following manner to obtain a reversal color photographic image.

| Processing Step | Temperature | Time |
|---|---|---|
| Hardening | 38°C | 1 minute |
| Washing | " | 1 minute |
| First Development | " | 3 minutes |
| Washing | " | 30 seconds |
| Reversal Exposure | (uniform exposure at 8,000 lux-second to the emulsion surface) | |
| Second Exposure | 38°C | 4 minutes |
| Washing | " | 1 minute |
| Bleaching | " | 1 minute |
| Washing | " | 30 seconds |
| Fixing | " | 1 minute |
| Washing | " | 1 minute |

The composition of each processing solution em ployed is given below.

| | |
|---|---|
| **Hardening Bath** | |
| Sulfuric Acid (1:1 by volume with water) | 5.4 cc |
| Sodium Sulfate | 150 g |
| Sodium Acetate | 20 g |
| Pyruvic Aldehyde (30% aqueous solution) | 15 cc |
| Formalin (37% aqueous solution) | 20 cc |
| Water to make | 1000 cc |
| **First Developer** | |
| 4-(N-Methylamino)phenol Sulfate | 2 g |
| Sodium Sulfite | 90 g |
| Hydroquinone | 8 g |
| Sodium Carbonate (monohydrate) | 52.5 g |
| Potassium Bromide | 5 g |
| Potassium Thiocyanate | 1 g |
| Water to make | 1000 cc |
| **Second Developer** | |
| Benzyl Alcohol | 5 cc |
| Sodium Sulfite | 5 g |
| Hydroxylamine Hydrochloride | 2 g |
| 4-Amino-3-methyl-N-ethyl-N-(β-methanesulfonamido-ethyl)aniline Sesquisulfate Monohydrate | 1.5 g |
| Potassium Bromide | 1 g |
| Trisodium Phosphate | 3 g |
| Sodium Hydroxide | 0.5 g |
| Ethylenediamine (70% aqueous solution) | 7 cc |
| Water to make | 1000 cc |

-continued

| | |
|---|---|
| Bleaching Solution B* | |
| Potassium Ferricyanide | 100 g |
| Sodium Acetate | 40 g |
| Glacial Acetic Acid | 20 cc |
| Potassium Bromide | 30 g |
| Water to make | 1000 cc |
| | Eredox = 410 mv |
| Fixing Solution | |
| Sodium Thiosulfate | 150 g |
| Sodium Acetate | 70 g |
| Sodium Sulfite | 10 g |
| Potassium Alum | 20 g |
| Water to make | 1000 cc |

*If there was a slight indication of silver occlusion, Bleaching Solution B was replaced with Bleaching Solution A and the subsequent washing was prolonged by an additional minute to thereby completely eliminate the silver occlusion.

| | |
|---|---|
| *Bleaching Solution A | |
| Ferric Chloride | 200 g |
| Sodium Chloride | 20 g |
| Sodium Citrate (dihydrate) | 30 g |
| Water, hydrochloric acid | 1 l |
| | (at pH 0.6) |
| | Eredox = 730 mv |

EXAMPLE 6

The samples obtained in Run Nos. 1 to 12 were subjected to optical wedge exposure under an exposure amount of about 500 lux.second using a light source of a color temperature of 2,854°K and then to development processing in the following manner.

| Processing Step | Temperature | Time |
|---|---|---|
| 1. Color Development | 30°C | 6 minutes |
| 2. Washing | " | 2 minutes |
| 3. Bleaching and Fixing | " | 1 minute and 30 seconds |
| 4. Washing | " | 2 minutes |

The composition of each processing solution used is given below.

| | |
|---|---|
| Color Developer | |
| Benzyl Alcohol | 12 ml |
| Diethylene Glycol | 3.5 g |
| Sodium Hydroxide | 2.0 g |
| Sodium Sulfite (anhydride) | 2.0 g |
| Potassium Bromide | 0.4 g |
| Sodium Chloride | 1.0 g |
| Borax | 4.0 g |
| Sodium Trinitriloacetate | 1.6 g |
| Hydroxylamine Sulfate | 2.0 g |
| 4-(N-Ethyl-N-β-methanesulfonamidoethyl)amino-2-methylaniline Sesquisulfate | 4.3 g |
| Water to make | 1000 ml |
| Bleaching and Fixing Solution | |
| Ferric Ethylenediaminetetraacetate | 40 g |
| Ammonium Thiosulfate (70%) | 150 ml |
| Sodium Sulfite (anhydrous) | 12.0 g |
| Water to make | 1000 ml |
| Stabilizing Solution | |
| Sodium Benzoate | 0.5 g |
| Glacial Acetic Acid | 13.0 ml |
| Citric Acid (dihydrate) | 4.2 g |
| Sodium Citrate (dihydrate) | 3.9 g |
| Water to make | 1000 ml |

The samples obtained in Run Nos. 4, 5, 6, 9 and 12 were equal in fog, color density and maximum sensitivity reached as compared with the samples obtained in Run Nos. 1, 7 and 10, and were excellent in transparency at relatively high density portions of the image as compared with the samples of Run Nos. 2, 3, 8 and 11.

The technique of this invention is widely applicable for usual black-white light-sensitive materials, X-ray light-sensitive materials, light-sensitive materials for plate making, light-sensitive materials for micro-film and, particularly, usual color photographic light-sensitive materials, color negative films, color papers, films for color slides, monochromatic light-sensitive materials, instant light-sensitive materials for rapid development processing in a camera, direct positive light-sensitive materials, or the like. Particularly, the invention can be applied to the production of photographic recording materials for amateur use.

While the invention has been described in detail and with reference to specific embodiments thereof, it will be apparent to one skilled in the art that various changes and modifications can be made therein without departing from the spirit and scope thereof.

What is claimed is:

1. A photographic light-sensitive material comprising a support having thereon at least one silver halide emulsion layer with the light-sensitive material containing in a hydrophilic colloid layer thereon at least two surface active agents selected from the compounds represented by the general formula (I)

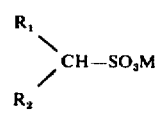

(I)

and the general formula (II)

$$R_3 - SO_3M \quad \text{(II)}$$

wherein, $R_1$ and $R_2$ each represents an aliphatic residue with the sum of the carbon atoms contained in $R_1$ and $R_2$ ranging from about 8 to 32; $R_3$ represents an aliphatic residue having about 8 and 20 carbon atoms; M represents a cation or a cationic group capable of forming a salt with a sulfonic acid; and compounds (I) are seondary alkane sulfonates and compounds (II) are primary alkane sulfonates.

2. The photographic light-sensitive material of claim 1, wherein said compounds represented by the general formulas (I) and (II) are alkanesulfonates and have a molecular weight ranging from about 200 to 800.

3. The photographic light-sensitive material of claim 1, wherein said hydrophilic colloid layer contains at least three surface active agents of the general formulas (I) and (II).

4. The photographic light-sensitive material of claim 1, wherein at least one of the silver halide photographic emulsions contains a color coupler.

5. The photographic light-sensitive material of claim 1, wherein said surface active agent represented by the general formula (II) is a $C_{13}$-n-alkane sulfonate, a $C_{14}$-n-alkane sulfonate, a $C_{15}$-n-alkane sulfonate, a $C_{16}$-n-alkane sulfonate, a $C_{17}$-n-alkane sulfonate or a $C_{18}$-n-alkane sulfonate, and the surface active agent represented by the general formula (I) is the secondary alkane sulfonates corresponding to the $C_{13}$- to $C_{18}$-n-alkane sulfonates of the general formula (II).

6. The photographic light-sensitive material of claim 4, wherein said light-sensitive material includes a blue-sensitive silver halide emulsion containing at least one of an open-chained acylacetamide coupler and an open-chained acylacetonitrile coupler as a yellow coupler, a green-sensitive silver halide emulsion containing at least one of a 5-pyrazolone coupler, a cyanoacetyl-coumarone coupler and an indazolone coupler as a magenta coupler, and a red-sensitive silver halide emulsion containing at least one of a naphthol coupler and a phenol coupler as a cyan coupler.

7. The photographic light-sensitive material of claim 6, wherein said yellow coupler is represented by the general formula (IV)

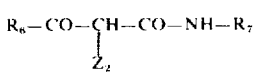

(IV)

wherein $R_6$ represents a primary, secondary or tertiary alkyl group having 1 to 18 carbon atoms, an aryl group, or an amino group; $R_7$ represents an aryl group; and $Z_2$ represents a hydrogen atom or a group capable of being split off during color development; said magenta coupler is represented by the general formula (III)

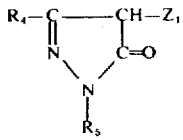

(III)

wherein $R_4$ represents a primary, secondary, or tertiary alkyl group, an aryl group, a heterocyclic ring, an amino group, a carbonamido group, a sulfonamido group, a ureido group, an alkoxy group, or an aryloxy group; $R_5$ represents a hydrogen atom, an aryl group, a heterocyclic group, or a primary, secondary or tertiary alkyl group; and $Z_1$ represents a hydrogen atom or a group capable of being split off during color development; and said cyan coupler is a coupler represented by the following general formula (V) or (VI)

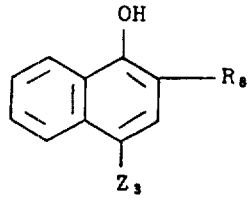

(V)

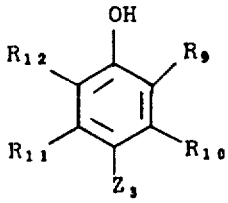

(VI)

wherein $R_8$ represents a carbamyl group, a sulfamyl group, an alkoxycarbonyl group, or an aryloxycarbonyl group; $R_9$ represents an alkyl group, an aryl group, a heterocyclic group, an amino group, a carbonamido group, a sulfonamido group, a sulfamyl group, or a carbamyl group; $R_{10}$, $R_{11}$ and $R_{12}$ each represents the same group as defined for $R_9$ and also represents a halogen atom or an alkoxy group; and $Z_3$ represents a hydrogen atom or a group capable of being split off during color development.

8. The photographic light-sensitive material of claim 1, wherein said at least two surface active agents are primary alkane sulfonates selected from the group consisting of $C_8$-n-alkane sulfonate, $C_9$-n-alkane sulfonate, $C_{10}$-n-alkane sulfonate, $C_{11}$-n-alkane sulfonate, $C_{12}$-n-alkane sulfonate, $C_{13}$-n-alkane sulfonate, $C_{14}$-n-alkane sulfonate, $C_{15}$-n-alkane sulfonate, $C_{16}$-n-alkane sulfonate, $C_{17}$-n-alkane sulfonate, and $C_{18}$-n-alkane sulfonate.

9. The photographic light-sensitive material of claim 1, wherein said primary alkane sulfonate and said secondary alkane sulfonate are selected from those having 8 to 18 carbon atoms.

* * * * *